United States Patent [19]

Brunel

[11] Patent Number: 5,020,493

[45] Date of Patent: Jun. 4, 1991

[54] DISTRIBUTOR FUEL INJECTION PUMP FOR INTERNAL COMBUSTION ENGINES

[75] Inventor: André Brunel, St. Genis Laval, France

[73] Assignee: Robert Bosch GmbH, Stuttgart, Fed. Rep. of Germany

[21] Appl. No.: 445,052

[22] Filed: Dec. 4, 1989

[30] Foreign Application Priority Data

Jan. 7, 1989 [DE] Fed. Rep. of Germany ..... 3900318

[51] Int. Cl.[5] ..... F02M 41/00; F02B 77/00

[52] U.S. Cl. ..... 123/198 DB; 123/450; 123/387; 417/462

[58] Field of Search ..... 123/198 D, 198 DB, 387, 123/386, 385, 450, 458, 357, 358, 359; 417/462, 219, 221, 252–253

[56] References Cited

U.S. PATENT DOCUMENTS

| | | | |
|---|---|---|---|
| 3,323,506 | 6/1967 | Pigeroulet | 123/450 |
| 4,377,139 | 3/1983 | Jarret | 123/198 D |
| 4,393,826 | 7/1983 | Tumber | 123/198 DB |
| 4,407,245 | 10/1983 | Eheim | 123/359 |
| 4,426,983 | 1/1984 | Seilly | 123/198 D |
| 4,441,474 | 4/1984 | Jarret | 123/450 |
| 4,574,759 | 3/1986 | Leblanc | 123/387 |
| 4,711,618 | 12/1987 | Abinett | 123/450 |
| 4,751,903 | 6/1988 | Pruneda | 123/387 |
| 4,840,162 | 6/1989 | Brunel | 123/450 |
| 4,913,632 | 4/1990 | Thornwaite | 123/387 |

*Primary Examiner*—Carl S. Miller
*Attorney, Agent, or Firm*—Edwin E. Greigg

[57] ABSTRACT

A distributor fuel injection pump for internal combustion engines, having a cam ring which drives at least one radial piston and having a distributor piston disposed transversely to the cam ring and defining a pump work chamber, having a distributor groove and longitudinal intake grooves in the jacket face. For shutoff of the engine, this distributor piston is axially displaceable and thereby undergoes a relative rotation relative to the cam ring, so that the longitudinal intake grooves upon the compression stroke of the pump piston come precisely to coincide with intake conduits and by this means the pumped fuel is pumped directly back into a suction chamber of the injection pump.

20 Claims, 3 Drawing Sheets

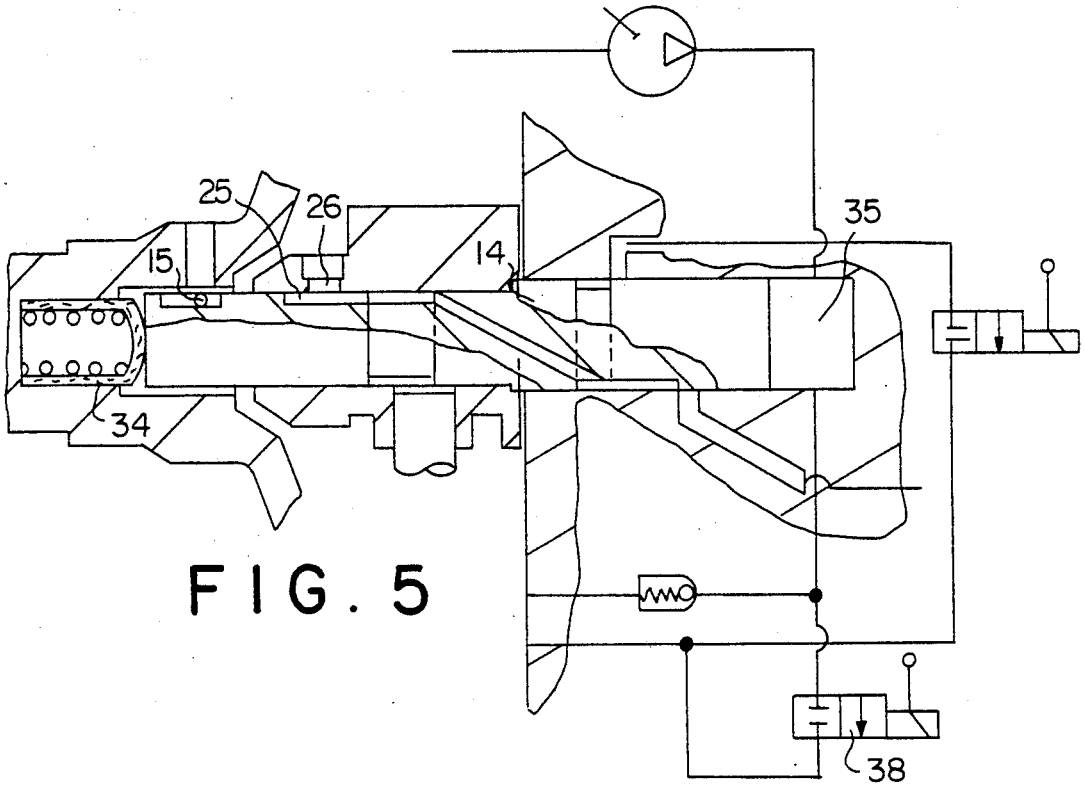
FIG. 5
FIG. 6
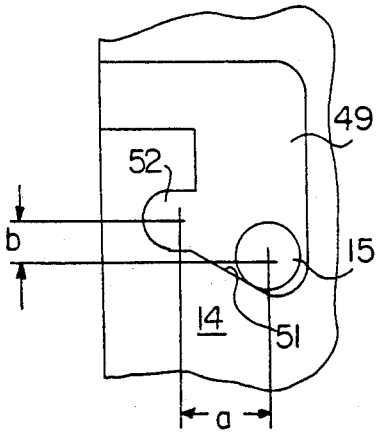
FIG. 7
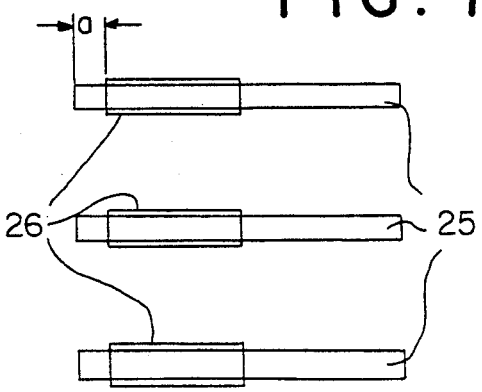

DISTRIBUTOR FUEL INJECTION PUMP FOR INTERNAL COMBUSTION ENGINES

BACKGROUND OF THE INVENTION

The invention is based on a distributor fuel injection pump for internal combustion engines as defined hereinafter.

In a fuel injection pump of this type (German Patent 37 17 807.6 and Austrian Patent 13.06.1987), it has already been proposed for shutoff of the engine or interruption of the injection of fuel to the engine to adjust the distributor piston axially counter to a restoring spring, after which longitudinal suction grooves, disposed in the jacket face of the distributor and one end of which communicates with the pump work chamber, emerge from the guide bore and thereby connect the pump work chamber directly to the suction chamber of the injection pump, even during the compression stroke of the pump piston. The quantity of fuel subsequently pumped by the radial piston is carried without pressure directly into the suction chamber. To attain an immediate pressure reduction after the displacement of the distributor piston, the stroke of the distributor piston must be relatively long, which has a disadvantageous effect on the entire construction, and above all, on the shutoff speed, because the relatively long stroke means that a correspondingly large amount of fuel is necessary for this control, to displace the distributor piston. To increase the shutoff speed, an enlarged cross section of the control valve passageway would be necessary, which in turn would necessitate increasing the positioning forces, for example brought to bear by a magnet.

OBJECT AND SUMMARY OF THE INVENTION

The distributor fuel injection pump according to the invention has an advantage over the prior art that for shutoff of the engine, only a slight displacement of the distributor piston is necessary, and this is determined by the steepness of the oblique control face; at the same time an outflow cross section that is equivalent to the intake cross section is opened. However, the intake cross section must always be large enough that even at maximum rpm it assures adequate filling of the pump work chamber. This cross section is then all the more sufficient for pressure relief in the compression stroke of the pump piston.

A further advantage of the invention is that the two terminal positions of the distributor position can be better defined.

In an advantageous feature of the invention, the guide recess is L-shaped, with a longitudinal groove serving to introduce fuel and discharging into the face end of the distributor piston, which is adjoined in the circumferential direction of the guide section by the oblique control face. With a catch prong in combination with the guide recess, the assembly is effected in the manner of a simple bayonet-like thrust and turn motion, without the danger of automonous uncoupling in the event of an extreme displacement of the distributor piston. In the assembly of the distributor piston, the catch prong need not be disassembled, either; accordingly a very simple and secure assembly and disassembly are assured.

In a further advantageous feature of the invention, the guide recess in the guide section has a pocket-like enlargement, which the prong hooks, into for normal operation of the fuel injection pump.

In a further advantageous feature of the invention, the intake conduits disposed in the distributor cylinder are slitlike, so that in the position of the distributor piston for shutoff of the engine, an optimal cross-sectional overlap exists between the intake openings and the distributor intake grooves.

In another advantageous feature of the invention, for shutting off the engine, the distributor piston is displaced counter to a restoring spring disposed in a bushing to limit the stroke and reduce friction.

The invention will be better understood and further objects and advantages thereof will become more apparent from the ensuing detailed description of a preferred embodiment taken in conjunction with the drawings.

BRIEF DESCRIPTION OF THE DRAWINGS

FIGS. 5–7 are views corresponding to those of FIGS. 2–4 for the stop position of the distributor piston.

DESCRIPTION OF THE PREFERRED EMBODIMENT

Figure 1:
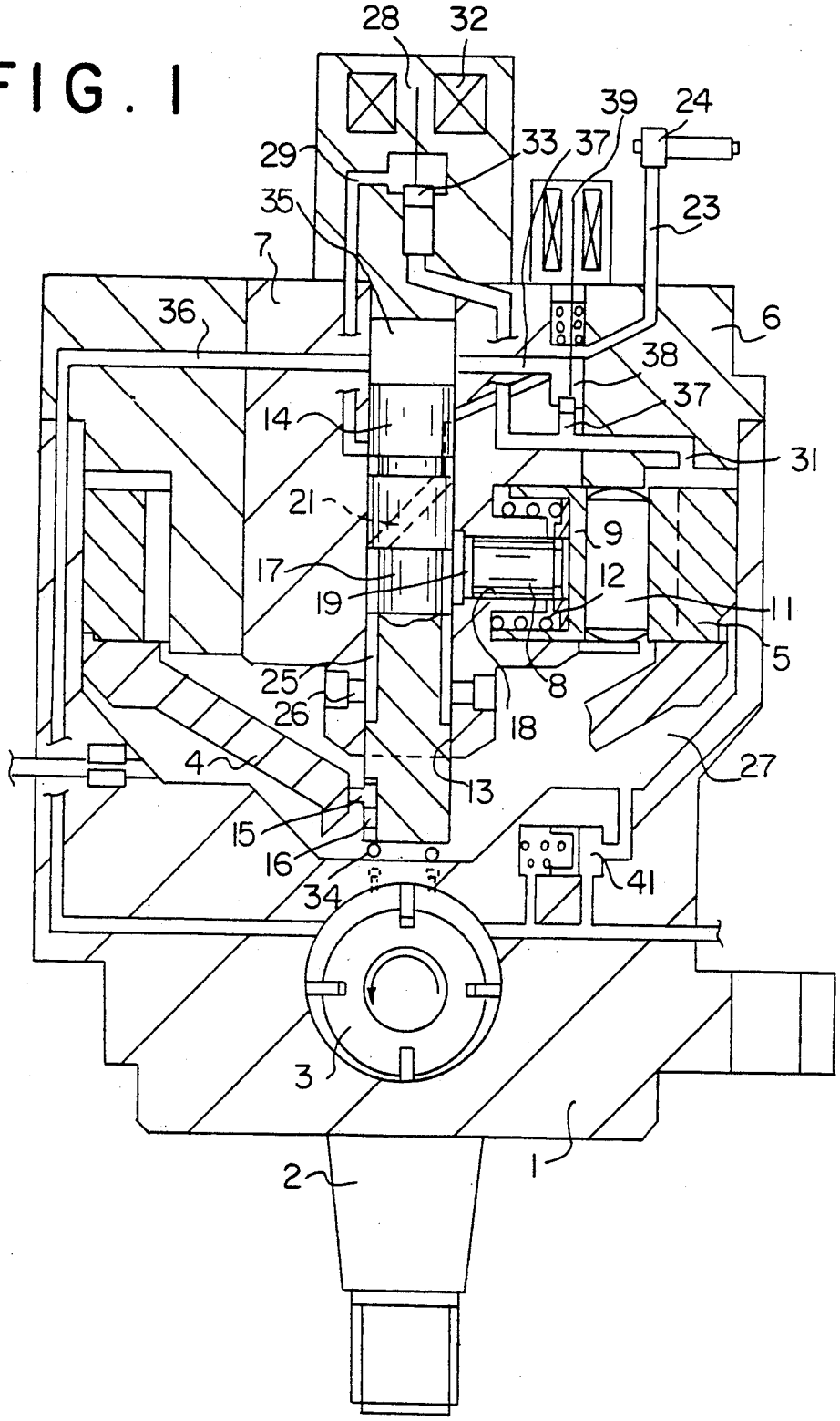
FIG. 1 is a longitudinal section of a distributor fuel invention pump.

The view selected in FIG. 1 of a distributor fuel injection pump is basically a longitudinal section through the distributor injection pump, although the sections are shown in various planes, to provide easier comprehension of the function of the pump. Some parts are also shown only in fragmentary form, for the sake of clarity.

As FIG. 1 shows, a driveshaft 2 that is driven at a speed synchronized with the engine rpm is supported in a housing 1. The driveshaft 2 drives a feed pump 3, which is shown here rotated by 90°, and which is supported in the pump housing 1. The driveshaft 2 also drives a cup-like catch element 4, which in turn drives a cam ring 5, which is supported for its rotation in the housing 1.

The pump housing 1 is closed by a housing head 6, in which a distributor cylinder 7 is disposed. Supported in the distributor cylinder 7 in radial bores are radial pistons 8, only one of which is shown and which is anchored with a roller shoe 9 of a drive roller 11. The roller shoe 9 is engaged by a piston spring 12, which presses the roller 11 against the cam race of the cam ring 5, in order to assure a reciprocating motion, determined by the cams, of the radial piston 8.

A central guide bore 13 is present in the distributor cylinder 7 and in it a distributor piston 14 is supported in an axially displaceable and rotatable manner. To transmit the rotary motion from the catch element 4 to the distributor piston 14, a catch prong 15 is disposed on the catch element 4, engaging a guide recess 16 in the jacket face of the distributor piston 14.

Also provided in the jacket face of the distributor piston 14 is an annular groove 1, which with the guide bore 13 and the corresponding face end of the radial piston 8, as well as the cylinder bore 18 receiving the radial piston 8, defines a pump work chamber 19.

From the pump work chamber 19, a bore 21 present in the distributor piston 14 leads to a distributor groove 22, which during a rotation of the distributor piston 14 comes successively into coincidence with pressure lines 23, the number of which is equivalent to the number of cylinders of the engine that are supplied with fuel. Each pressure line 23 leads to one injection nozzle 24, only one of which is shown, however. Whenever the radial piston 8 executes its compression stroke, the distributor groove 22 coincides with one of the pressure lines 23, so as to enable pumping to one of the fuel injection nozzles 24.

During the intake stroke of the radial piston 8, the pump work chamber 19 communicates, via longitudinal intake grooves 25 disposed in the jacket face of the distributor 14 and intake conduits 26 cooperating with these grooves 25, with a suction chamber 27 that is filled with fuel at a predetermined pressure. The number of longitudinal intake grooves 25 and intake conduits 26 is equivalent to the number of pressure lines 23, so that during the intake stroke of the pump piston 8 an intake cross section of considerable size is available.

The control of the injection quantity is effected via a magnetic valve 28, which controls a relief conduit 29 of the pump work chamber 19, this conduit discharging at its other end 31 into the suction chamber 27. That is, as soon as the magnet 32 of the magnetic valve 2 actuates the movable valve element 33 after itself being electrically excited and thereby opens up the relief conduit 29, no injection can take place via the injection nozzle 24; instead, the fuel pumped by the radial piston 8 is pumped back out of the pump work chamber 19 into the suction chamber 27.

The shutoff of the engine or an interruption in the injection is attained, with this pump, in that the distributor piston 14 is axially displaced; as described below, it undergoes a slight relative rotation relative to the catch element 4 in this process. To enable this displacement, a restoring spring 34 engages the distributor piston 14 in the direction of the operating position, on the one hand, while the other face end plunges into a control chamber 35, by way of which the fuel pumped at a predetermined pressure by the feed pump 3 is pumped into the suction chamber 27. Serving this purpose are a feed conduit 36, which discharges into the control chamber 35, and a feed line 37 extending from it, which then comes to an end in the relief conduit 29, which at 31 discharges into the suction chamber 27.

In this feed line 37, a shutoff valve 38 embodied as a magnetic valve is provided, which as soon as it is closed causes a backup of the quantity of fuel pumped by the feed pump 3, so that a backup pressure can build up in the control chamber 35 above the end face of the distributor piston 14. As soon as sufficient pressure is attained, the distributor piston 14 is displaced counter to the force of the restoring spring 34, so that because of the relative rotation of the distributor piston 14 with respect to the catch element 4, a short-circuit connection is brought about between the pump work chamber 19 and the suction chamber 27 even during the compression stroke of the radial pistons 8, via the longitudinal intake grooves 25 and the intake conduits 26. As a result of this relative rotation, the short circuit toward the intake side takes place already during the compression stroke of the radial piston 8, while contrarily during normal operation, the intake side has just been blocked during the compression stroke of the radial piston 8, and the longitudinal intake grooves 25 have just been separated from the intake conduits 26.

Also as a result of this relative rotation of the distributor piston 14, the distributor groove 22 is no longer in coincidence with the pressure line 23 during the compression stroke of the radial piston 8. As soon as the shutoff valve 38 is then opened by excitation of the magnet 39, the pressure in the control chamber 35 collapses, and the distributor piston 14 is displaced back into its outset position by the restoring spring 34.

In order to assure sufficient pressure in the suction chamber 27 for filling of the pump work chamber 19 during the intake stroke of the radial piston 8, a pressure valve 41 is provided between the suction chamber 27 and the intake side of the feed pump 3.

The distributor fuel injection pump described functions as follows. As soon as the driveshaft 2 is rotated upon startup of the engine, the radial piston or pistons 8 begin their reciprocating pumping motion. By means of the rotating cam ring 5, the inner cam race of this cam ring 5 is drawn over the rollers 11 of the radial pistons 8, and the piston springs 12 assure a form-fitting contact between the rollers 11 and the cam race, so that each radial piston 8, on being driven by the piston spring 12, executes an intake stroke, and on being driven by the cams executes a compression stroke. During the intake stroke of the radial piston 8, fuel is pumped into the pump work chamber 19 from the suction chamber 27 via the longitudinal intake grooves 25 and the intake grooves 26. Upon further rotation of the distributor piston 14, the longitudinal intake grooves 25 are disconnected from the intake conduits 26, and the distributor groove 22 is brought into coincidence with one of the pressure lines 23, so that in the compression stroke of the radial piston 8 that begins in the meantime, fuel is pumped out of the pump work chamber 19, via the bore 21 and the distributor groove 22, into the pressure lines 23 to the nozzles 24. The quantity of fuel to be injected at any time is limited by the provision that the magnetic valve 28, after excitation of the electromagnet 32, opens at the proper time, so that the remaining fuel pumped during this compression stroke flows back into the suction chamber 27 via the relief conduit 29. After the end of the compression stroke and before the onset of the intake stroke of the radial piston 8, the magnetic valve 28 is closed once again, so that the injection cycle can start over again. When the engine is started, the shutoff valve 38 is opened by excitation ,of the magnet 39, so that the distributor slide 14 remains in its outset position. For shutoff of the engine, for example via the ignition key, the magnet 39 is de-excited, and the shutoff valve 38 is closed, so that the feed pump pressure established in the control chamber 35 displaces the distributor piston 14 counter to the force of the restoring spring 34, so that during the compression stroke of the radial piston 8 the longitudinal intake grooves 25 come into coincide with the intake conduits 26.

Governing of the injection pump to attain the desired characteristic curves is effected via an electronic control unit, by way of which the magnet 32 of the magnetic valve 28 is triggered. Other individual operating characteristics may be picked up (not shown) in part from the fuel injection pump, but also from the engine or the environment, via suitable transducers, and processed in the electronic control unit.

Figure 2:
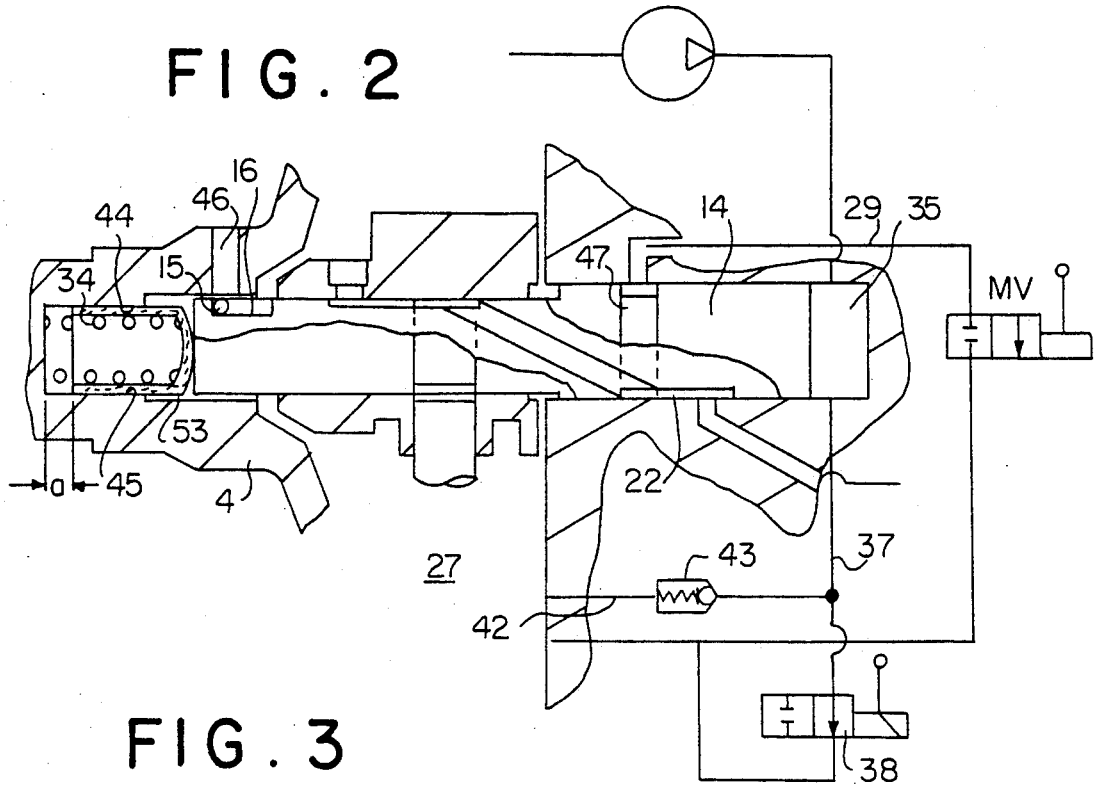
FIG. 2 shows a detail of FIG. 1 on a larger scale for the operating position of the distributor piston.

In FIG. 2, on a larger scale and to some extent (magnetic valves, feed pump) shown schematically, the elements important to the invention are shown. Beyond what has already been shown in FIG. 1, this diagram shows that an overpressure line 42 branches off from the feed line 37 upstream of the shutoff valve 38, discharging directly into the suction chamber 27. Disposed in this overpressure line 42 is a one-way check valve 43, by means of which the pressure in the control chamber 35 required for adjusting the distributor piston 14 can be defined.

FIG. 2 also shows that the restoring spring 34 is encased by a bushing 44, in order to avoid tilting of the spring or unnecessary friction with the wall of the blind bore 45 receiving the spring 34, because that could impair the displacement motion of the distributor piston 14 and hence the shutoff of the engine.

The catch prong 15 is disposed on a bolt 46, which is secured in a corresponding radial bore of the catch element 4.

To keep the relief conduit 29 as short as possible and moreover to locate the relief point as close as possible to the fuel distribution point, namely the distributor groove 22, an annular groove 47 that communicates with the distributor groove 22 is provided in the distributor piston 14 and cooperates with the entry to the relief conduit 29.

Figure 3:
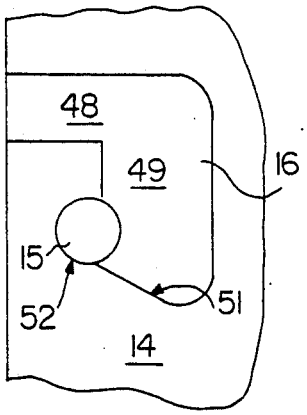
FIG. 3 is a developed view, on a still larger scale, of the guide recess.

In FIG. 3, a developed view of the jacket face of the distributor piston 14 is shown in the vicinity of the guide recess 16, and the L-shaped extension of this recess can be seen, with a longitudinal guide groove 48, a guide section 49 having an oblique control face 51, and a pocketlike unilateral enlargement 52.

Upon the entry of the distributor piston 14 into the corresponding blind bore 54 of the catch element 4, the catch prong 15 slides in the longitudinal guide groove 48, before it then, in bayonet-like fashion in the guide section 49, reaches the oblique control face 51. Upon axial displacement of the distributor piston 14 for shutoff of the engine, the catch prong 15 then slides along the oblique control face 51 out of the pocketlike enlargement 52, and because of the obliqueness of the control face 51 a corresponding relative rotation of the distributor piston 14 with respect to the catch element 4 takes place.

Figure 4:
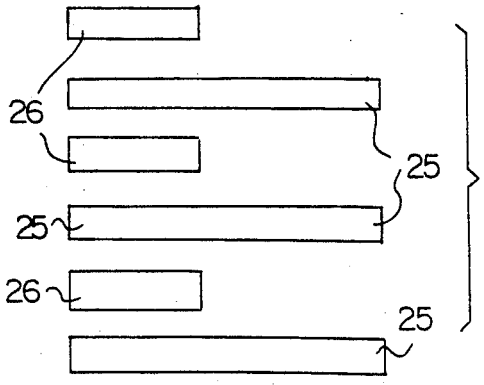
FIG. 4 is a schematic diagram of the longitudinal intake grooves and intake conduits for the operating position of FIG. 2.

In FIG. 4, the association of the longitudinal intake grooves 25, disposed in the jacket face of the distributor piston 14, with the mouths, oriented toward them, of the intake conduits 26 is shown. As can clearly be seen, the intake conduits 26 here are also embodied as slits, to obtain the greatest possible coincidence with the longitudinal intake grooves 25.

While the various positions shown in FIGS. 2–4 correspond to normal operation of the pump, and as seen in FIG. 3 the catch prong 15 engages the pocketlike enlargement 52, the various elements assume a position for shutoff of the engine in FIGS. 5–7. While the shutoff valve 38 in FIG. 2 is opened, to avoid a backup in the control chamber 35, in FIG. 5 this shutoff valve 38 is blocked, as a result of which, via the backup in the control chamber 35, the distributor piston 14 is displaced toward the left into the position shown, counter to the force of the restoring spring 34. In this displacement, the catch prong 15 migrates out of the pocketlike enlargement 52 along the oblique control face 51 into the position shown in FIG. 6, and correspondingly the distributor piston 14 is rotated relatively by the distance b, at a given stroke a. The catch prong 15 therefore remains in contact with the oblique control face 51, because of the slaving force between the catch prong 15 and the distributor piston 14.

The relative rotation b has the effect that now, as shown in FIG. 7, the longitudinal intake grooves 25 are in coincidence with the slits of the intake conduits 26 to permit flow of fuel from the pump work chamber 19 back to the suction chamber 18.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A distributor fuel injection pump for internal combustion engines, comprising, a housing, a suction chamber and a distributor piston in said housing;

a driven cam ring;

at least one pump piston driven via said cam ring counter to a restoring force for a reciprocating working stroke;

said pump piston including a pump work chamber;

a distributor piston, the axis of which extends at right angles to the axis of the pump piston and which with the pump piston defines a pump work chamber, a distributor groove and longitudinal intake grooves disposed parallel to the distributor piston axis in the jacket face of the distributor piston, said longitudinal intake grooves can be made to communicate via intake conduits with said suction chamber and the distributor groove can be made to communicate with pressure lines leading to the engine, wherein said distributor groove is offset relative to the longitudinal intake grooves for the distributor motion such that via these grooves an opening of the intake conduits and pressure lines is not simultaneously possible;

a controlled longitudinal displacement of said distributor piston, in which after execution of a predetermined stroke said longitudinal intake grooves are made to communicate with said suction chamber for pressure relief of said pump work chamber, said distributor piston including a control face extending obliquely to the axis thereof; upon the longitudinal displacement of the distributor piston (14), by means of said control face (51) extending obliquely to the axis of the distributor piston (14), a relative rotation of the distributor piston (14) is effected such that during a compression stroke of the pump piston (8) said longitudinal intake grooves (25) are in coincidence with said intake conduits (26), so that the fuel in the pump work chamber is pumped directly back into the suction chamber (27).

2. A fuel injection pump as defined by claim 1, in which said oblique control face (51) forms a defining face of a guide recess (16) in a jacket face of the distributor piston (14), which recess is engaged by a catch prong (15) of a catch element (4), via which catch element a rotation of the distributor piston (14) relative to the pump piston (8) is effected.

3. A fuel injection pump as defined by claim 2, in which said guide recess (16) has an L-shaped opening cross section and a longitudinal guide groove (48), that discharges into the face end of the distributor piston (14), and a guide section (49) extending in the rotational direction, the guide section having a limiting wall forming the oblique control face (51).

4. A fuel injection pump as defined by claim 2, which includes a pocketlike enlargement (52) present in the guide recess (16) adjoining the oblique control face (51) in a longitudinal direction which enlargement is engaged by the catch prong (15) during normal operation.

5. A fuel injection pump as defined by claim 3, which includes a pocketlike enlargement (52) present in the guide recess (16) adjoining the oblique control face (51) in a longitudinal direction which enlargement is engaged by the catch prong (15) during normal operation.

6. A fuel injection pump as defined by claim 1, in which said intake conduits (26) are embodied as slits extending parallel to the longitudinal intake grooves (25).

7. A fuel injection pump as defined by claim 2, in which said intake conduits (26) are embodied as slits extending parallel to the longitudinal intake grooves (25).

8. A fuel injection pump as defined by claim 3, in which said intake conduits (26) are embodied as slits extending parallel to the longitudinal intake grooves (25).

9. A fuel injection pump as defined by claim 4, in which said intake conduits (26) are embodied as slits extending parallel to the longitudinal intake grooves (25).

10. A fuel injection pump as defined by claim 5, in which said intake conduits (26) are embodied as slits extending parallel to the longitudinal intake grooves (25).

11. A fuel injection pump as defined by claim 1, in which an adjustment of the distributor piston (14) is effected counter to a restoring spring (34), and that said restoring spring (34) is disposed in a bushing (44) which limits an allowable stroke of the distributor piston (14).

12. A fuel injection pump as defined by claim 2, in which an adjustment of the distributor piston (14) is effected counter to a restoring spring (34), and that said restoring spring (34) is disposed in a bushing (44) which limits an allowable stroke of the distributor piston (14).

13. A fuel injection pump as defined by claim 3, in which an adjustment of the distributor piston (14) is effected counter to a restoring spring (34), and that said restoring spring (34) is disposed in a bushing (44) which limits an allowable stroke of the distributor piston (14).

14. A fuel injection pump as defined by claim 4, in which an adjustment of the distributor piston (14) is effected counter to a restoring spring (34), and that said restoring spring (34) is disposed in a bushing (44) which limits an allowable stroke of the distributor piston (14).

15. A fuel injection pump as defined by claim 5, in which an adjustment of the distributor piston (14) is effected counter to a restoring spring (34), and that said restoring spring (34) is disposed in a bushing (44) which limits an allowable stroke of the distributor piston (14).

16. A fuel injection pump as defined by claim 6, in which an adjustment of the distributor piston (14) is effected counter to a restoring spring (34), and that said restoring spring (34) is disposed in a bushing (44) which limits an allowable stroke of the distributor piston (14).

17. A fuel injection pump as defined by claim 7, in which an adjustment of the distributor piston (14) is effected counter to a restoring spring (34), and that said restoring spring (34) is disposed in a bushing (44) which limits an allowable stroke of the distributor piston (14).

18. A fuel injection pump as defined by claim 8, in which an adjustment of the distributor piston (14) is effected counter to a restoring spring (34), and that said restoring spring (34) is disposed in a bushing (44) which limits an allowable stroke of the distributor piston (14).

19. A fuel injection pump as defined by claim 9, in which an adjustment of the distributor piston (14) is effected counter to a restoring spring (34), and that said restoring spring (34) is disposed in a bushing (44) which limits an allowable stroke of the distributor piston (14).

20. A fuel injection pump as defined by claim 10, in which an adjustment of the distributor piston (14) is effected counter to a restoring spring (34), and that said restoring spring (34) is disposed in a bushing (44) which limits an allowable stroke of the distributor piston (14).

* * * * *